US006431626B1

(12) United States Patent
Bouligny

(10) Patent No.: US 6,431,626 B1
(45) Date of Patent: Aug. 13, 2002

(54) TUBULAR RUNNING TOOL

(75) Inventor: Vernon J. Bouligny, New Iberia, LA (US)

(73) Assignee: Frankis Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 09/502,898

(22) Filed: Feb. 11, 2000

Related U.S. Application Data

(63) Continuation-in-part of application No. 09/289,375, filed on Apr. 9, 1999, now Pat. No. 6,309,002.

(51) Int. Cl.[7] ..... E21B 31/20

(52) U.S. Cl. ..... 294/86.25; 294/86.15; 166/177.4

(58) Field of Search ..... 294/86.1, 86.15, 294/86.24, 86.25, 86.34; 166/285, 117.5, 206, 212, 217, 99, 117, 177.4

(56) References Cited

U.S. PATENT DOCUMENTS

| | | | | | |
|---|---|---|---|---|---|
| 776,523 | A | * | 12/1904 | Lukins | 294/86.25 |
| 1,445,680 | A | * | 2/1923 | Guess | 294/86.25 |
| 1,580,352 | A | * | 4/1926 | Ventresca | 294/86.25 |
| 1,619,254 | A | * | 3/1927 | Hart | 294/86.25 |
| 1,621,947 | A | * | 3/1927 | Moore | 294/86.25 |
| 2,108,499 | A | * | 2/1938 | Moseley | 294/86.25 |
| 3,265,431 | A | * | 8/1966 | Burner | 294/86.25 |
| 3,758,146 | A | * | 9/1973 | Kaercher et al. | 294/86.25 |
| 4,093,294 | A | * | 6/1978 | Taylor | 294/86.25 |
| 4,235,469 | A | * | 11/1980 | Denny et al. | 294/86.25 |
| 4,244,616 | A | * | 1/1981 | Buchalet | 294/86.25 |
| 4,320,915 | A | * | 3/1982 | Abbott et al. | 294/86.25 |
| 4,875,530 | A | * | 10/1989 | Frink et al. | 175/27 |
| 4,919,881 | A | * | 4/1990 | Hankinson et al. | 294/86.25 |
| 5,551,521 | A | * | 9/1996 | Vail, III | 166/285 |
| 5,641,021 | A | * | 6/1997 | Murry et al. | 166/177.4 |
| 5,735,348 | A | * | 4/1998 | Hawkins, III | 166/177.4 |
| 5,884,698 | A | * | 3/1999 | Hughes et al. | 166/117.6 |
| 5,887,660 | A | * | 3/1999 | Yokley et al. | 166/386 |
| 5,890,537 | A | * | 4/1999 | LaVaure et al. | 166/285 |
| 5,918,673 | A | * | 7/1999 | Hawkins et al. | 166/177.4 |
| 5,960,881 | A | * | 10/1999 | Allamon et al. | 166/285 |
| 6,010,171 | A | * | 1/2000 | Margiottiello | 294/56.25 |

FOREIGN PATENT DOCUMENTS

| | | | | |
|---|---|---|---|---|
| GB | 2221706 | * | 2/1990 | 294/86.25 |

* cited by examiner

*Primary Examiner*—Eileen D. Lillis
*Assistant Examiner*—Paul T. Chin
(74) *Attorney, Agent, or Firm*—The Matthews Firm

(57) ABSTRACT

An improved tubular running tool and method is disclosed for use on a rotary or top drive drilling rig of the type for inserting and selectively, internally gripping a tubular which may be utilized to lift, lower, rotate, and torque tubulars, and which may be used to fill and/or circulate fluid in and through tubulars and to cement tubulars within a wellbore. The internal tubular running tool may be used as or in conjunction with fill-up and circulating tools and with cementing head wiper plug assemblies among other tools. The tubular running tool includes an improved moving mechanism having a cylindrical pneumatic chamber annularly positioned with respect to a barrel element that forms an axial fluid pathway therethrough. A cylindrical piston is moveable within the cylindrical chamber to thereby move a cylindrical piston rod connected to gripping slips such that the slips selectively engage an interior portion of a tubular member.

15 Claims, 7 Drawing Sheets

Slips Up

Slips down

TUBULAR RUNNING TOOL

This application is a continuation-in-part of U.S. patent application Ser. No. 09/289,375 filed Apr. 9, 1999, now U.S. Pat. No. 6,309,002.

TECHNICAL FIELD

The present invention relates to a tool for running tubulars into subterranean wellbores, and more specifically to an improved moving mechanism in the tool whereby the tool is operable for internally gripping a tubular member for torquing individual tubular joints or strings, rotating and/or reciprocating a tubular string which is additionally adapted for filling and circulating fluid in and through a tubular string and for cementing a tubular string within a wellbore.

BACKGROUND

Subterranean wells are drilled for many purposes, including the recovery of hydrocarbons, carbon dioxide, and removal of contaminants. Additionally, subterranean wells are drilled for the purpose of injecting substances back into subterranean formations, such as hydrocarbons into a salt dome, water into a reservoir, and disposal of hazardous material.

The process of drilling subterranean wells consists of drilling a hole in the earth down to a reservoir or formation in which a substance is intended to be removed from or injected. Hereinafter this disclosure will refer to the process in regards to drilling for recovery of hydrocarbons, although the tool of the present application is adapted for the use in any type of drilling operation.

Typically, in the drilling of wells, the well is drilled in sections. After each section of the well is drilled a casing string is placed within the wellbore. Casing is pipe which is placed in the wellbore to form a conduit from the subterranean reservoir to the surface. Casing also prevents the wellbore from collapsing and provides a barrier to the flow of fluids between formations which the wellbore penetrates. Once a string of casing is run into the hole, it is typically cemented in place. It is very common for a well to include more than one section of casing, each section having a different diameter from other sections of casing.

Casing is commonly run into the hole one joint or stand at a time. Each joint is picked up and then connect to the top most joint of the casing string which is typically supported at the rig floor by casing spider. Power tongs may then be used to threadedly connect the additional casing joint to the casing string in the hole. Once the joint or stand of casing has been connected to the casing string, a casing elevator which normally grips the outside diameter of the casing is lowered over the added joint or stand and activated so as to grip the casing string. The casing string is then lifted by the external casing elevator thus allowing the spider to release the casing string. Once the spider grip has released the casing string the string may be lowered into the wellbore.

As each additional joint or stand of casing is connected to the casing string, as set out above, it is filled with fluid for running into the hole. This fluid prevents floatation of the casing string, maintains pressure within the well to prevent formation fluid from coming back up the hole, and prevents the casing from collapsing. The filling of each joint or stand of casing as it is run into the hole is the fill-up process. Lowering the casing into the wellbore is typically facilitated by alternately engaging and disengaging elevator slips and spider slips with the casing string in a step wise fashion, facilitating the connection of an additional stand of casing to the top of the casing string as it is run into the hole. The prior art discloses hose assemblies, housings coupled to the uppermost portion of the casing, and tools suspended from the drill hook for filling the casing.

When casing is run into the hole it is sometimes necessary to circulate fluid. Circulating fluid requires pumping a fluid down the interior of the casing, out the bottom of the casing and back up the hole through the annulus between the casing and wellbore. Fluid is circulated through the well when casing gets stuck in the hole, to clean the hole, to condition the drilling fluid, to test the well and surface equipment, and to cement the casing within the wellbore.

Circulation of the fluid is sometimes necessary when resistance is encountered as the casing is lowered into the wellbore, preventing the running of the casing string into the hole. This resistance to running the casing into the hole may be due to such factors as drill cuttings, mud cake, caving of the wellbore, or a tight hole among other factors. In order to circulate the drilling fluid, the top portion of the casing must be sealed so that the interior of the casing may be pressurized with fluid. Since the casing is under pressure the integrity of the seal is critical to safe operation, and to minimize the loss of expensive drilling fluid. Once the obstruction is removed the casing may be run into the hole as before.

Often when casing is stuck in the hole, circulation of fluid alone is insufficient to free the casing. At these times it is necessary to rotate and reciprocate the casing to free it. Heretofore, it was necessary to rig down prior art fill-up and circulating tools to rig up tools to rotate and reciprocate the casing string. In these situations it was impractical to then be able to circulate fluid while the casing is being rotated and reciprocated. This process of rigging up and down is very time consuming, costly, and increases the risk of injury to rig personnel.

Once the casing string is run into the hole to a desired depth it is cemented within the hole. The purpose of cementing the casing is to seal the casing to the wellbore formation. In order to cement the casing within the wellbore it is common practice to remove the assembly which is used to fill and/or to circulate fluid from the drilling rig and a cementing head apparatus is installed atop the casing string. This process is time consuming, requires significant manpower, and subjects the rig crew to potential injury when handling and installing the additional equipment.

The prior art discloses separate devices and assemblies for (1) filling drilling fluid in and circulating fluid through tubular members or strings; (2) lowering, and torquing individual joints or strings of tubulars; (3) rotating and reciprocating tubulars members or strings; and (4) cementing operations. These prior art assemblies requiring re-rigging of equipment each time a new sequence in the running and setting of casing is changed. An internal elevator is disclosed in U.S. Pat. No. 4,320,915 assigned to Varco International, Inc. As disclosed, this prior art internal elevator does not disclose or provide a conduit through the elevator for filling the tubular member with a fluid or circulating fluids through the tubular string.

It would be a benefit therefore, to have an internal elevator adapted for internally gripping tubulars and allowing fluid to be pumped through the tool which may be used with top drive or rotary drilling rigs. It would be a further benefit to have an internal elevator which allows an operator to torque individual tubular joints or strings together or apart, rotate, and reciprocate tubular joints or strings. It would be a still further benefit to have an internal elevator which may used both-in filling tubulars with fluid and circulating fluid therethrough. It would be an additional benefit to have an internal elevator which may be used in conjunction with conventional fill-up and circulating tools, and cementing apparatus.

GENERAL DESCRIPTION

Accordingly, a tubular running tool adapted for use on a rotary or top drive drilling rig of the type for inserting and selectively, internally gripping a tubular which may be utilized to lift, lower, rotate, and torque tubulars, and which may be used to fill and or circulate fluid in and through tubulars and to cement tubulars within a wellbore is provided. The internal tubular running tool may be used as or in conjunction with fill-up and circulating tools and with cementing heads wiper plug assemblies among other tools. The tubular running tool includes: a barrel forming an axial fluid pathway therethrough, the barrel having a top end and a bottom end, the barrel forming a lower connecting section; at least one slip movably connected to the connecting section for selectively engaging an interior portion of a tubular member; and a moving mechanism functionally connected between the slips and the barrel for moving the slips in engaging contact with and from the tubular member. The tubular running tool may further include a sealing element for sealing the annulus between the tool and the interior surface of the tubular.

In a preferred embodiment, the barrel has a top end which is adapted for connecting equipment thereto such as top drive assemblies, push plate assemblies, various pups or subs, and cementing heads. The barrel may form an elevator section for connecting elevators thereto. The lower end is adapted for connecting tools such as fill-up and circulating tools, mud saver valves, and wiper plug assemblies among other tools and equipment.

The connecting section may be tapered, tapering outwardly toward the bottom end or the downhole portion of the barrel. The tapered section may be conical or substantially conical in form. In a preferred embodiment of the present invention the tapered section is faceted. The faceted portions of the tapered section may be substantially planar. The slips are movably connected to the tapered section. In a preferred embodiment, the slips are movably connected to each faceted and/or planar section which is formed. One mode of movably connecting the slips to the planar sections is via a retaining pin extending from an interior side of the slip and insertable into a slot formed by the faceted section. The slips are movable along the tapered section in a manner such that as the slips are moved towards the lower or broader end of the tapered section the slips are moved outwardly from the barrel and into engaging contact with the interior wall of the tubular in which the device is inserted. When the slips are moved towards the upper or narrower portion of the tapered section the slips are disengaged from gripping contact with the internal wall of the tubular.

The slips may be conventional type slips which are used in elevators and in spiders, however, the slips are inverted. These slips may have formed thereon ribs or gripping surfaces for gripping the tubular. In a preferred embodiment, the slips have removable gripping inserts, providing the ability to easily replace the gripping portion of the slips as they wear through use.

A moving mechanism is connected between the slip(s) and the barrel to facilitate the movement of the slips along the connecting section into and out of gripping contact with the tubular. This mechanism may be a pneumatic or hydraulic cylinder including a piston or rod, or other well known moving assemblies. In one preferred embodiment, the moving mechanism is a pneumatic cylinder because of its reliability and the available source of pressurized air on the drilling rig. The improved moving mechanism of the present invention comprises a tubular cylinder housing mounted in encircling relationship to the barrel and a cylindrical rod moveable within the tubular cylinder housing. A piston is mounted within the tubular cylinder housing is secured to the cylinder rod. The piston is preferably in encircling relationship to the barrel member. The tubular cylinder housing may further comprise an inner cylindrical element and an outer cylindrical element with the cylinder rod being moveable therebetween.

The moving mechanism may be directly connected to the slips or may be connected to the slips via arms which facilitate the movement of the slips along the connecting section. Additionally, a single moving mechanism may be functionally connected to more than one slip via means such as a sleeve or ring in connection between the moving mechanism and the slips. One such embodiment includes a sleeve movably connected about the barrel, the sleeve functionally connected between the moving mechanism and the slips such that as the moving mechanism is operated the sleeve moves along a portion of the barrel thereby moving the slips along the length of the connecting section.

Another intended and preferred embodiment includes an upper and lower sleeve movably connected or disposed about the barrel. The moving mechanism, or cylinder and rod in this example is connected to both the upper and lower sleeve. The cylinder is further functionally connected directly to, or via the lower sleeve and preferably movable arms to the slips. In this manner, when it is desired to internally grip the tubular the moving mechanism is activated, the upper sleeve is then moved toward the upper end of the barrel and the lower sleeve toward the connecting section thereby moving the slips downwardly and outwardly along the connecting section thereby engaging and gripping the interior of the tubular. This movement of the slips, via the upper and lower sleeve, provides a visual means for the operator to determine when the slips are in a position gripping the interior of the tubular. When desired to disengage the tool from contact with the tubular, the moving mechanism is again activated moving the upper sleeve and lower sleeve toward one another thereby moving the slips upward along the connecting section and out of contact with the interior of the tubular.

The internal gripping, tubular running tool may additionally be used as a fishing tool. In this embodiment, the tool in its most rudimentary embodiment may be run into the hole to stab into a string or joint of pipe which is lost in the hole. The moving mechanism is then activated so as to move the slips into engagement with the interior wall of the dropped string or joint Once engagement is accomplished the lost string or joint can be raised to the surface for removal, and the tubular running operation continued.

The tubular running tool may be used as a fill-up and circulating tool or in combination with a fill-up and circulating tool. When used as a fill-up and circulating tool the tubular running tool may include a sealing element attached to the barrel. The sealing element may be an inflatable packer, a flexible cup, or any other device which will seal against the tubular in which inserted, substantially preventing fluid to flow from below the sealing element through the annulus formed between the tool and the tubular and above the sealing element. In this configuration, the tubular running tool may further include equipment such as a mud saver valve, a guide ring, guide nose, and/or a nozzle connected to the lower end of the tubular running tool.

The tubular running tool may be used in combination with a fill-up and circulating tool. One such tool is described in U.S. Pat. No. 5,735,348, although the tubular running tool of the present invention may be used with all known fill-up and circulating tools. The fill-up and circulating tool may be connected to the upper or lower end of the tubular running tool, although it is preferred to run the fill-up and circulating tool connected to the lower end of the tubular running tool.

When the casing is run to the desired depth and drilling fluid filling and circulation is no longer required, the assembly may be configured for the cementing process. The drilling fluid lines are disconnected and replaced with the cement pump lines. After the drilling fluid flow is stopped, the apparatus is withdrawn from the casing to expose the lower end of the tubular running tool or the connected fill-up and circulating tool. The mud saver valve and hose extension assembly may be simply uncoupled from the lower body of the apparatus and a cementing wiper plug assembly connected to the lower end of the tubular running tool or to the fill-up and circulating tool connected to the tubular running tool. Additionally, a cementing head or cementing plug container is connected to the top end of the apparatus. The apparatus with the cement plug assembly and cement pump lines installed is then lowered back into the casing. Once the sealing device is engaged with the casings the cementing process begins. The plug release mechanism may be initiated at the appropriate times during the cementing process to release the cement wiper plugs.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

DESCRIPTION

Figure 1:
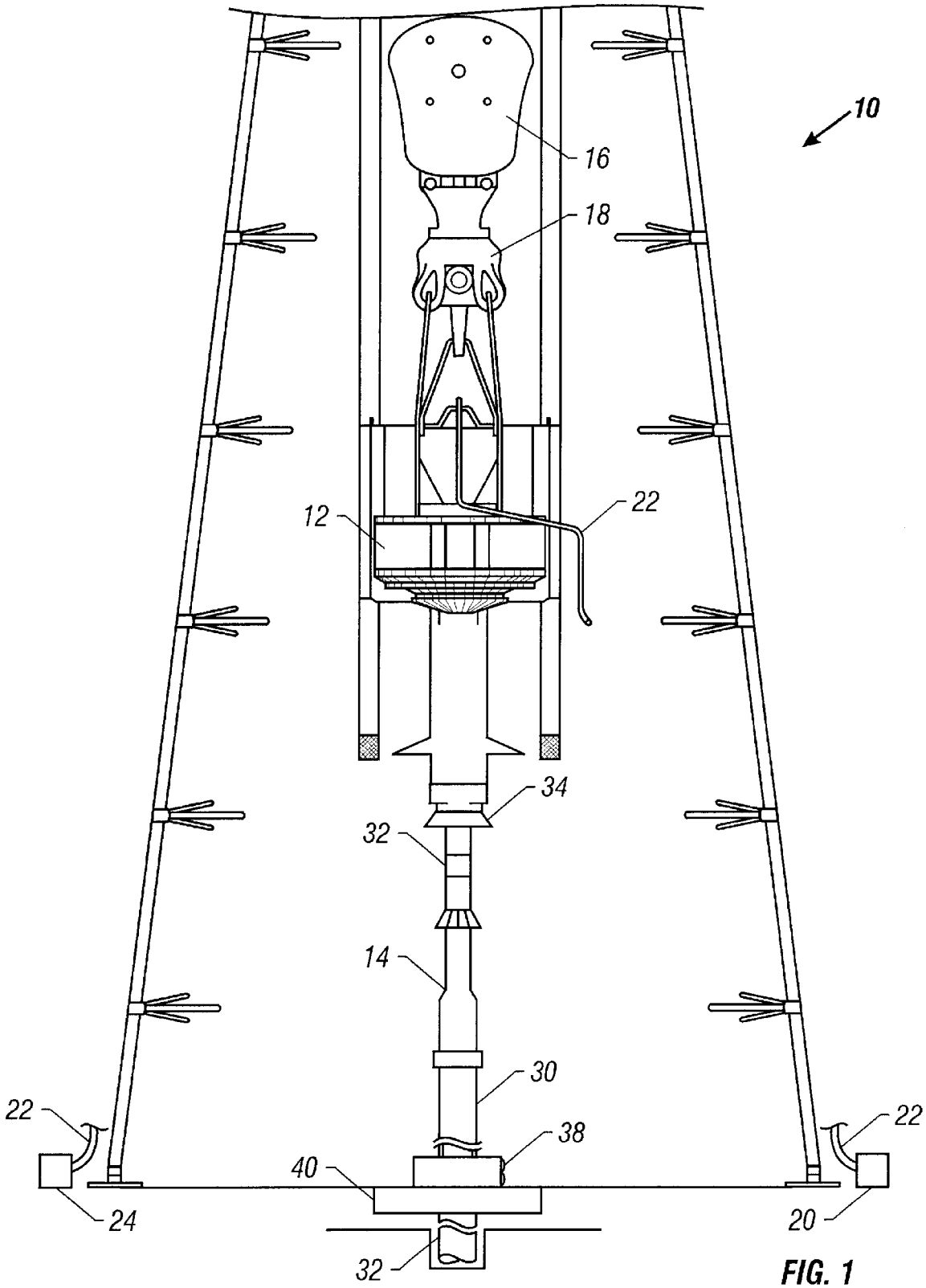
FIG. 1 shows a top drive rig assembly utilizing the tubular running tool of the present invention.

FIG. 1 is a perspective view of a drilling rig 10, having a top drive unit 12, utilizing the internal tubular elevator of the present invention generally designated by the numeral 14. Those skilled in the art will know that suspended from the traveling block 16 is a hook 18. Pressurized fluid, such as drilling fluid, is delivered from the drilling fluid pumps 20 through hose 22 directly to top drive 12. Other fluids such as a cement slurry may be delivered via pump 24 through hose 22 directly through top drive unit 12 or directly to internal elevator 14 (not shown).

Figure 2:
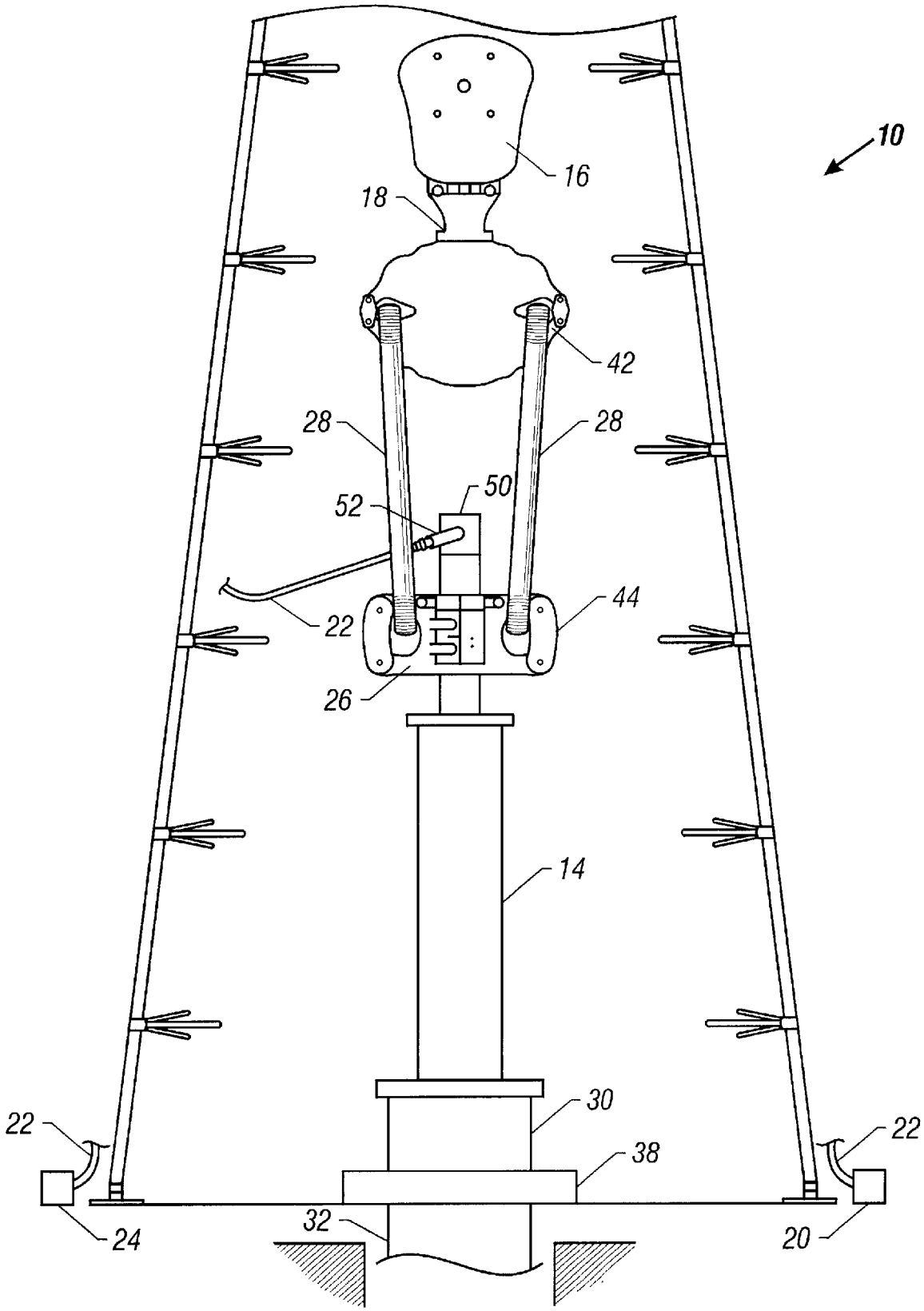
FIG. 2 is a perspective view of a conventional rotary rig utilizing the internal gripping tool of the present invention.
Figure 3:
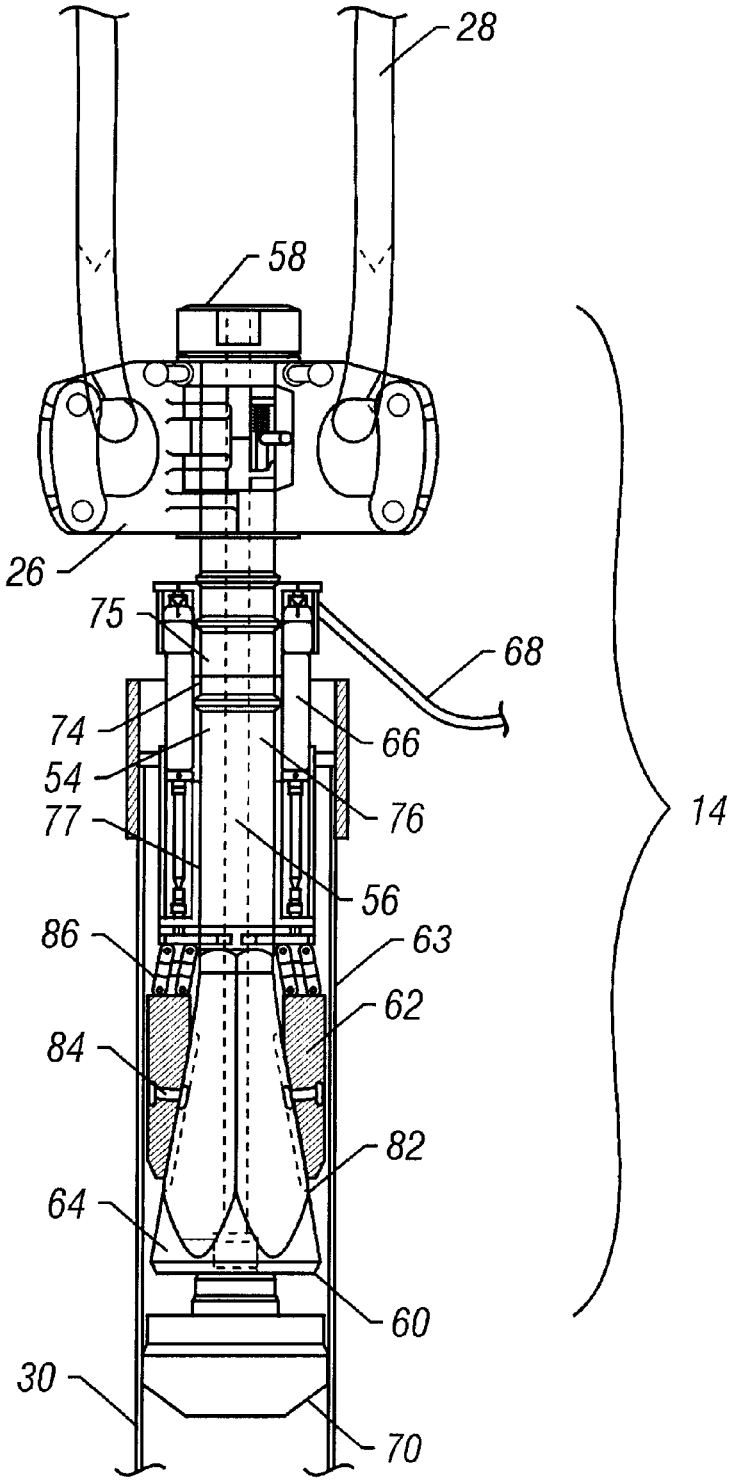
FIG. 3 is a partial cross-sectional view of the internal tubular gripping tool of the present invention inserted within a tubular.

Internal tubular elevator 14 may be utilized by a top drive unit 12 rig by several methods, one method is to connect internal elevator 14 directly to top drive unit 12, indirectly to top drive unit 12 via mechanical connections, as shown in FIG. 1 and more fully described below, or by being held by an external elevator 26 which may be suspended by links 28 as shown in FIGS. 2 and 3. By directly or indirectly connecting to the drive shaft (not shown) of top drive unit 12, internal gripping tool 14 may be positioned to make-up or break threaded connections of single joints or strings of tubulars 30 such as casing. Additionally, direct and indirect connection of internal gripping tool 14 to top drive 12 aids in the rotation of tubular 30 when tubular 30 is stuck in wellbore 32.

As shown, a top sub box connection assembly 32 is threadedly connected at one end to a top drive pin shoulder 34, and at the other end connected to internal gripping tool 14. A catch plate 36 may be connected between internal gripping tool 14 and top sub box 32 as a stop to engage against the uppermost portion of tubular 30 if tool 14 becomes disengaged from top drive unit 12. In such a configuration as well as by directly connecting tool 14 to the drive shaft of top drive 12, tool 14 may be inserted within tubular 30 for torquing the tubular in relation to another joint/string of tubulars, to rotate, lift, lower tubular 30 or to fill, and/or circulate tubular 30 with a fluid. It should be well recognized that tubular 30 may represent a single tubular joint or several joints interconnected to form a tubular string.

Once internal gripping tool 14 is inserted within tubular 30 and tool 14 is engaged with the interior of tubular 30, tool 14 and tubular 30 may be lowered through the rotary or spider slips 38, rotary table 40, and into wellbore 32 via top drive 12. As tubular 30 is being lowered it may be filled with drilling fluid via internal gripping tool 14. If tubular 30 becomes stuck in wellbore 32, top drive 12 may be utilized to lift, lower, or rotate internal gripping tool 14 and thus tubular 30. If movement alone is not sufficient to free tubular 30 within wellbore 32, drilling fluid may be pumped through tool 14 into tubular 30 and out the bottom of tubular 30 and back up the hole through the annulus between tubular 30 and wellbore 32, Once the top of tubular 30 is at slips 38, slips 38 are engaged to maintain tubular 30 in place and internal gripping tool 14 is released and a new tubular joint is then picked up from the rack or stand and stabbed into the top of tubular 30. If not already performed gripping tool 14 is inserted within the top of the new joint or stand of tubular and engaged with the interior of the new tubular. Internal gripping tool 14 may then be rotated via top drive unit to torque and make up the connection of the newest tubular joint with tubular 30. Additionally, joints of tubulars 30 may be torqued up by external mechanisms such as power tongs. The previous steps are then repeated to run tubular 30 into the hole. When required, tubulars 30 maybe removed from wellbore 32 by reversing the process.

FIG. 2 is a perspective view of a conventional rotary rig utilizing the internal gripping tool of the present invention, generally designated by the numeral 14. As well known in the art, rig 10 has a traveling block 16 and suspended therefrom is hook 18. External elevator 26, a center latch elevator, is suspended from block 16 and hook 18 via bails 28 which are connected on one end to ears 42 formed by hook 18 and on the end to ears 44 formed by elevator 26. As shown, elevator 26 is connected to a top portion of internal gripping tool 14, as more fully described below As well known in the art, fluid pumps 20 and 24 may be connected to internal elevator 14 in many different manners, including hose 22, connectors, various subs and tees, and cementing heads. Although not shown, push plates and the like may be added within the assembly so that weight may be added when necessary to push tubular 30 through tight spots within wellbore 32.

Connected atop internal gripping tool 14 is an adapter 50 which has a fluid port 52 connected thereto which is connected to fluid pumps 20 or 24 via hose 22. To introduce fluid into tubular 30 for filling, circulating, or cementing, fluid pump 20 or 24 is activated discharging fluid into hose 22, through fluid port 52 into adapter 50 and through internal gripping tool 14.

Operation of internal gripping tool 14 is substantially the same as described in reference with FIG. 1, and described in more detail below. It should be noted that in the configuration as shown in FIG. 2, that when running tubular 30 into wellbore 32, the use of internal elevator 14 allows the running of the top end of tubular 30 closer to rotary or spider slip 38 then is possible with conventional elevator and rotary slips.

FIG. 3 is a partial, cross-sectional view of internal tubular gripping tool 14 of the present invention inserted within a tubular 30. As shown tool 14 is suspended from bails 28 and elevator 26. For illustrative purposes, tool 14 is connected to rig 10 (FIGS. 1 & 2) via elevator 26 which may be part of a conventional rotary rig or a top drive rig. Connection of tool 14 is readily available from FIG. 1 and many variations of connections to the drive shaft of top drive 12 (FIG. 1) is contemplated. Additionally, for illustrative purposes FIG. 3 does not disclose the connection of fluid lines of which examples have been set out above and of which many known methods in the prior art are obvious.

As shown in FIG. 3, internal tubular gripping tool 14 is partially inserted within tubular 30. Internal tubular gripping tool 14 includes a barrel 54 forming an axial fluid pathway 56 therethrough in fluid connection with a top end 58 and a bottom end 60. Top end 58 is adapted for connecting directly or via connections to top drive 12 (FIG. 1), various cementing heads, subs, hoses, connections, and other apparatus which are not shown, but well known in the art. Bottom end 60 is adapted for connecting additional tools such as fill-up and/or circulating tools, mud saver valves, cementing plug/wiper assemblies, and other apparatus which may be used in running tubulars and or fishing operations. When fill up and/or circulating tools are not being used a tapered guide 70 may be attached in order to facilitate inserting the internal tabular gripping tool 14 into tubular 30.

Figure 7:
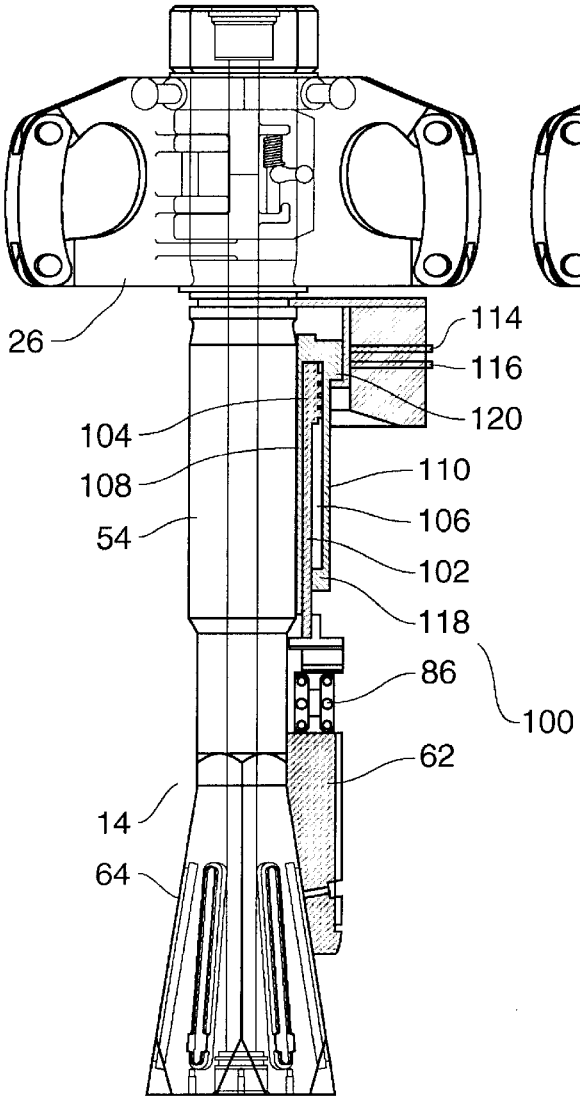
FIG. 7 is an elevational view, in partial cross-section, of the internal tubular gripping tool in the slips up position with a moving mechanism in accord with the present invention.
Figure 8:
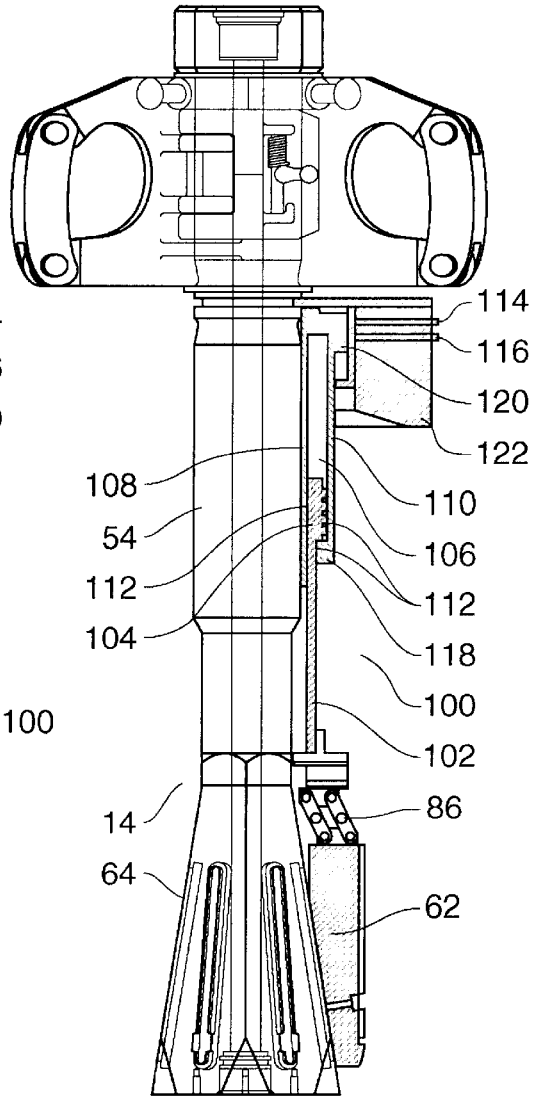
FIG. 8 is an elevational view, in partial cross-section, of the internal tubular gripping tool of FIG. 7 in the slips down position.

Internal gripping tool 14 further includes slips 62 which are movably connected to a tapered section 64 of tool 14. Slips 62 may include gripping members 63 which are attached to slips 62 and adapted for gripping the interior of tubular 30. Slips 62 are functionally connected to a moving mechanism 66, which is in connection with barrel 54. As shown in FIG. 3, moving mechanism 66 comprises pneumatic cylinders and rods, which are connected via lines 68 to a controlled pneumatic source (not shown). Moving mechanism 66 may be operated pneumatically, hydraulically, electrically or by any other means available to selectively operate mechanism 66 and move slips 62. In a preferred embodiment a top portion of moving mechanism 66 is connected to an upper sleeve 75 which is moveably connected to upper sleeve section 74 (FIG. 4) of barrel 54 and a lower portion of moving mechanism 66 may be connected to a lower sleeve 77, which may be moveably connected about a lower sleeve section 76 of barrel 54. Slips 62 are moveable from a first position in which slips 62, and/or gripping elements 63, are not in engaging contact with the interior of tubular 30 and to a second position in which slips 62, and/or gripping elements 63, are in engaging contact with the interior of tubular 30. Internal 14 includes a guide nose 70 connected to bottom end 60. Another presently preferred embodiment of the moving mechanism is shown in FIGS. 7 and 8 discussed hereinafter.

Figure 4:
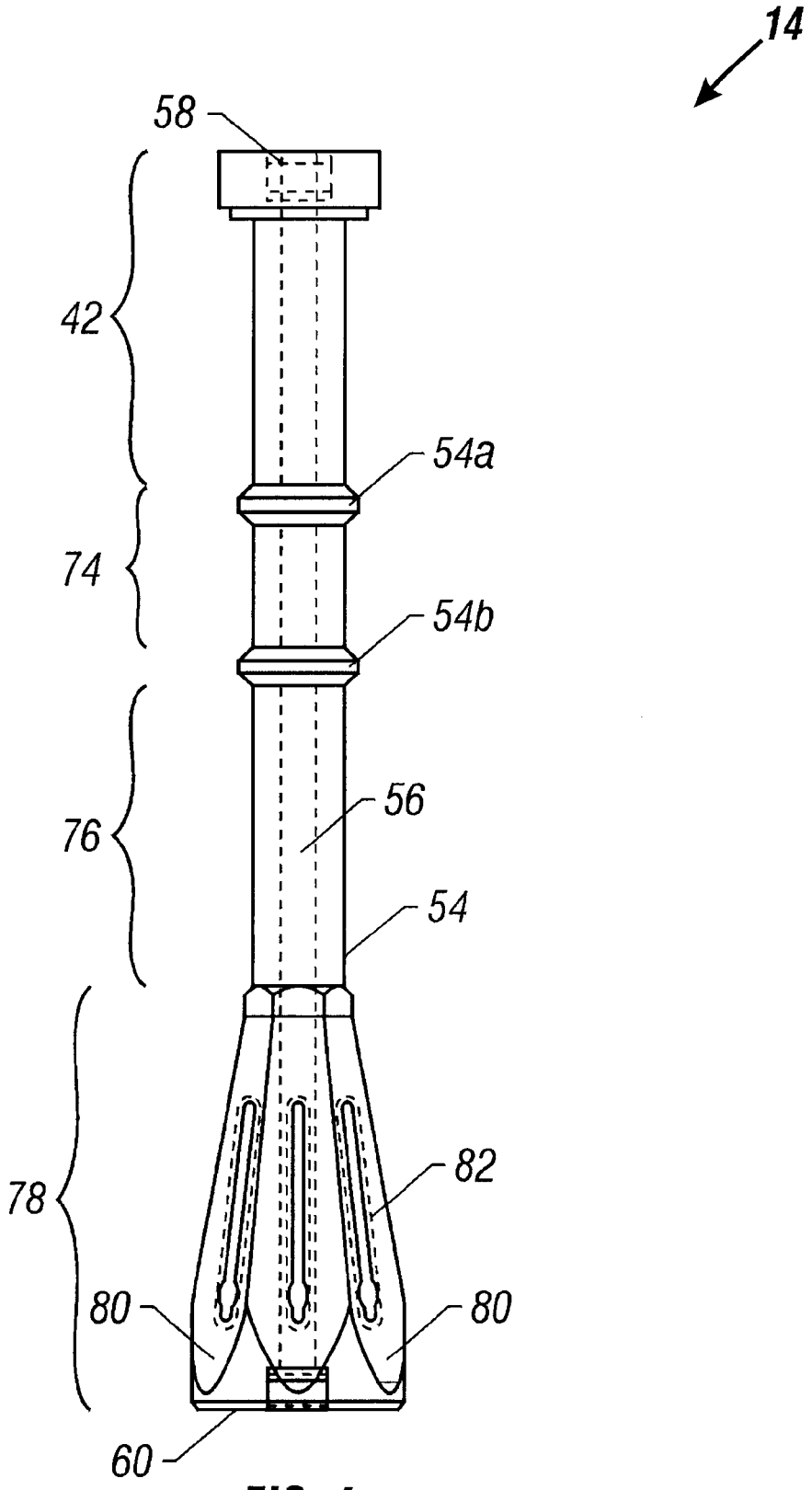
FIG. 4 is a side view of the barrel of the internal casing elevator of the present invention.

FIG. 4 is a side view of barrel 54 of internal casing elevator 14 of the present invention. Internal casing elevator 14 includes barrel 54 forming an axial fluid pathway 56 between a top end 58 and bottom end 60. Barrel 54 includes an elevator section 72, an upper sleeve section 74, a lower sleeve section 76, and a slip section 78. In the preferred embodiment slip section 78 is tapered outwardly towards bottom end 60 and forms slot(s) 82 for movably connecting slips 62 (FIG. 3) thereto. It is also preferred that slip section 78 form at least one planar section 80 having slots 82.

Internal casing elevator 14 is described with reference to FIGS. 1 through 5. Top end 58 is adapted for connecting directly or via connectors to the drive shaft of top drive unit 12. Top end 58 is further adapted for connecting other apparatus such as cementing heads and the like. Elevator section 72 is provided for connecting elevator 26 of either a rotary or top drive rig assembly 10.

Slips 62 which may include removable gripping members 63 are movably connected to slip section 78 of barrel 54. One means of movably connecting slips 62 is via retaining members 84, shown as bolts or pins, connected to slip section 78 and slips 62 through slots 82. Connected to slips 62 is moving mechanism 66 (FIG. 3) which includes a pneumatic cylinder and rods which are operationally connected to a pneumatic source via lines 68. It is preferred that one end of moving mechanism 66 be movably attached about upper sleeve section 74 and movable between upper sleeve shoulders 54*a* and 54*b*. The end of moving mechanism 66 connected to upper sleeve section 74 may be a collar or sleeve disposed about section 74 and welded to moving mechanism 66. Moving mechanism 66 may be fixedly connected about section 74 if desired. It is preferred for stability, that a portion of moving mechanism 66 be movably connected to lower sleeve section 76 by a sleeve or collar, The lower end of moving mechanism 66 is connected to slips 62 via arms 86. One reason for movably connecting a portion of moving mechanism 66 about upper sleeve section 72 is to provide a visual means for an operator to determine when slips 62 are engaged with the interior of tubular 30.

As previously described, slip section 78 is tapered outwardly in the direction of bottom end 60 of tool 14. It is also preferable that slip section 78 have planar section(s) 80 so as to form a substantially faceted slip section 78. Planer sections 80 provide a stable surface so that when slips 62 are moved into engaging contact. with the interior surface of tubular 30, tool 14 may be rotated, such as in the top drive configuration, reducing the tendency of slips 62 from moving within tubular 30 thus reducing the damage to tubular 30 by scarring and also increasing the ability to apply torque to make-up or break joints of tubulars 30. Further, the tapered and planar configuration of slip section 78 makes tool 14 very adaptable to tubulars 30 of varying wall thickness without having to change slips 62 and or gripping elements 63. As it is known in the art, tubulars 30 having the same outside diameter have varying inside diameters depending on the schedule or pressure rating of tubulars 30. Within a string of tubulars 30 being run into wellbore 32, there may be several sections having different outside diameters, within a section having a single outside diameter there may be sections having different inside diameters. Therefor it is desirable and cost effective to provide a tool 14 which maybe utilized with tubulars 30 having various inside diameters. Having a tapered section 64 with planar sections 80 increases the ability of tool 14 for internally gripping tubulars 30 of varying inside diameters.

Figure 5:
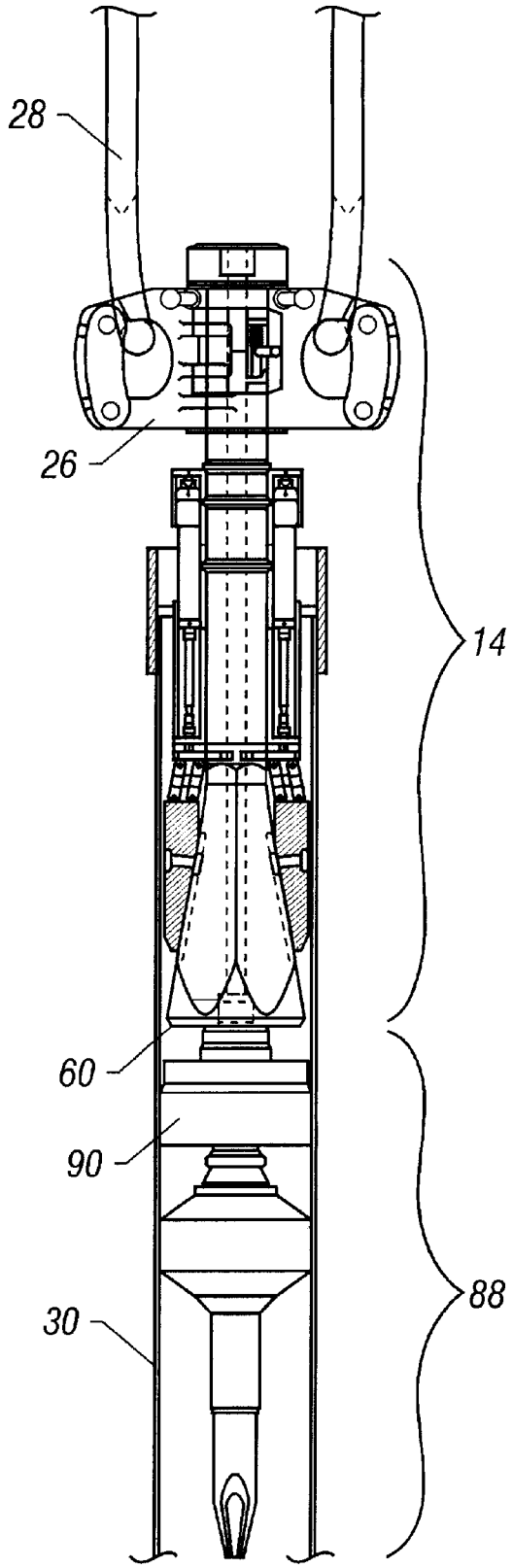
FIG. 5 is a partial cross-sectional, view of the internal tubular gripping tool of the present invention in conjunction with a fill-up and circulating tool.

FIG. 5 is a partial cross-sectional, view of internal tubular gripping tool 14 of the present invention in conjunction with a fill-up and circulating tool 88. As shown, internal gripping tool 14 is hung foam an elevator 26, however, it is adaptable to direct or indirect connection to top drive unit 12 (FIG. 1) as described above. Additionally, hose 22 (FIG. 1) is not shown connected to tool 14 for illustrative purposes because of the many different manners in which hose 22 may be connected.

Fill-up and circulating tool 88 connected to bottom end 60 of tool 14 as shown in FIG. 5, is the tool disclosed in U.S. Pat. No. 5,735,348, issued Apr. 7, 1998, and the associated patent applications and patents related thereto, all of which are incorporated herein by reference. Fill-up and circulating tool 88 includes a sealing member 90, which may be any type of sealing member known in the art such as a cup type packer, or inflatable sealing member. Sealing member 90 may be activated so as to prevent fluid flow from below member 90 through the annulus between tubular 30 and member 90.

Figure 6:
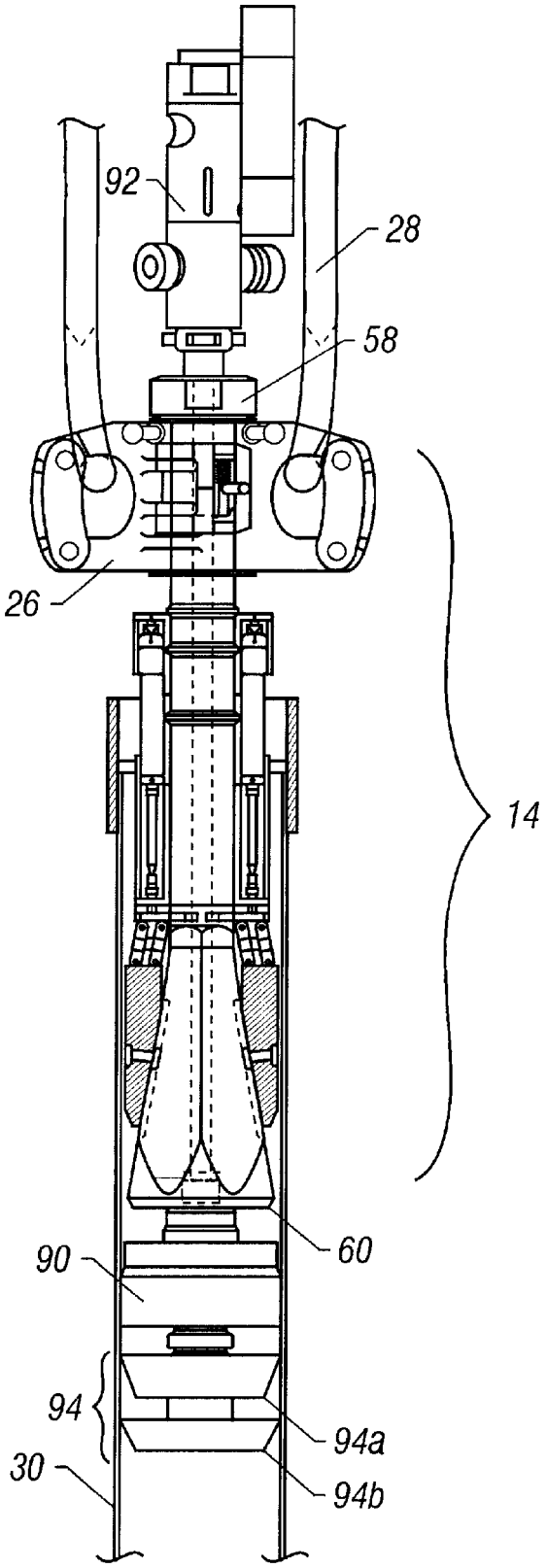
FIG. 6 is a partial cross-sectional, perspective view of the internal casing elevator of the present invention adapted for cementing tubulars within a wellbore.

FIG. 6 is a partial cross-sectional,.perspective view of internal tubular gripping tool 14 of the present invention adapted for cementing tubular 30 within wellbore 32. As shown, tool 14 is shown suspended from an elevator 26. For cementing tubular 30 within wellbore 32 (FIGS. 1 and 2) a cementing head or ball drop assembly 92 is shown connected to top end 58 of tool 14. Connected below sealing element 90, which as described above may be part of tool 14 or connected thereto is a wiper plug assembly 94. Wiper plug 94 includes a detachable top wiper plug 94*a* and at least one detachable wiper plug 94*b*. Although not shown various methods are known in the art to connect fluid lines to release balls or darts within cementing head 92 to detach wiper plugs 94*a* and 94*b*, and to pump drilling fluid and cement slurry in order to cement tubular 30 within wellbore 32 (FIGS. 1 and 2). For one description of use of cementing apparatus 92 and 94, reference should be made to U.S. Pat. No. 5,735,348 which is incorporated herein, although, use of tool 14 is not limited to the cementing apparatus of U.S. Pat. No. 5,735,348.

In FIG. 7 and FIG. 8, a presently preferred moving mechanism 100 is disclosed that is operable for moving slips 62 along the inclined or tapered section 64. The slips up position is shown in FIG. 7 and the slips down position is shown in FIG. 8. Moving mechanism 100 in this embodiment comprises a hollow rod cylinder mounted in surrounding or encircling relationship with respect to barrel 54. Thus, the components of this embodiment of moving mechanism 100 are preferably ring-shaped, tubular, and/or cylindrical. Moving mechanism 100 includes tubular cylinder rod 102 that connects to slips 62 through pivotal arms 86. It will be apparent that the tubular structure of cylinder rod 102 is quite sturdy. Piston 104 is secured to cylinder rod 102 preferably at an upper end thereof. Piston 104 drives cylinder rod 102 for reciprocal motion thereof. Piston 104 is also tubular and, like cylinder rod 102, is annularly disposed with respect to barrel 54. Piston 104 moves within cylinder 106. Cylinder 106 of the presently preferred embodiment is defined by an inner cylinder body element 108 and an outer cylinder body element 110 to form a cylindrical cylinder housing that defines cylinder 106. In a preferred embodiment of the hollow rod cylinder of moving mechanism 100, construction of the elements is of a cylindrical and telescoping nature. Various suitable seals 112 may be used to provide a seal for relative movement between piston 104, cylinder body elements 108 and 110, and cylinder rod 102. Preferably cylinder body elements are distinct from barrel 54 rather than formed or attached as a part thereof and, in fact, cylinder 106 is preferably moveable with respect to barrel 54. Cylinder 106 may be operated pneumatically wherein the pneumatic connections are made to rear port 114 and rod-end port 116. Rear port 114 permits pneumatic pressure above piston 104 and rod-end port includes a passageway disposed in outer cylinder body element 110 to permit pneumatic or air pressure below piston 104 at 118. Thus, pneumatic power can be used to move piston 104 upwardly and downwardly as indicated in a linear direction for moving slips 62 up and down. Ports 114 and 116 may be provided in cylinder end cap 120 as indicated. Cylinder end cap 120 is preferably moveable within support bracket 122 to provide the visual indication of whether slips 62 are up or down as discussed hereinbefore.

Moving mechanism 100 may in a presently preferred embodiment be used in place of separate pneumatic cylinders, such as four pneumatic cylinders located at ninety degree intervals around barrel 54. It will be apparent that other means may be used to operate moving mechanism 100 such as, for instance, hydraulic means.

Operation of tubular running tool is now described with reference to FIGS. 1 through 8. Internal gripping tool 14 may be utilized in by either a top drive 12 rig or rotary rig. When used in the top drive configuration tool 14 may be connected directly to the drive shaft of top drive unit 14, connected to the drive shaft via connectors, or hung from elevators 26. In the rotary drive configuration, tool 14 is hung from elevators 26. Utilization of tool 14 in with top drive unit 12 aids tool 14 in torquing tubular 30 for making or breaking single joints or stands of tubulars 30. Additionally, the top drive configuration is very beneficial in rotating tubular 30 when tubular 30 is stuck within wellbore 32.

Internal tubular running tool 14 is connected within either the top drive or rotary rig configuration. Hose 22 in connection with mud pump 20 is functionally connected to tool 14 so as to provide fluid through tool 14. Tool 14 may be constructed with a sealing element 90, a sealing element 90 may be connected to tool 14, and/or a fill-up and circulating tool 88 having a sealing element 90 may be connected to tool 14. Internal tubular running tool 14 is substantially inserted within tubular 30 and fluid may be pumped through hose 22 and tool 14 to fill tubular 30 with fluid.

To internally grip tubular 30, moving mechanism 66 is activated via a pressure source (not shown), such as pressurized air which is readily available on most rigs, through conduit 68 moving slips 62 and gripping members 63 downward and outwardly along tapered section 64 into engaging contact with the interior surface of tubular 30. In the preferred embodiment, when slips 62 are moved downwardly a top portion of moving mechanism 66, such as the cylinder, which is movably connected via an upper sleeve 75 to upper sleeve section 74, upper sleeve 75 is urged towards upper barrel shoulder 54*a* indicating to the operator that tool 14 is engaging tubular 30. An upper portion of moving mechanism 66 may be fixedly connected to barrel 54. When it is desired to disengage from gripping contact with tubular 30, moving mechanism 66 is activated via pressure conduit 68 to raise slips 62 along tapered section 64 until slips 62 and gripping elements 63 are out of gripping engagement with tubular 30. Moving mechanism 66 may be connected to a pressure source by many different types of control apparatus well known in the art for selectively operating moving mechanism 66 and slips 62 into and out of engagement with tubular 30.

Once tool 14 is engaged with tubular 30, tubular 30 may be lowered into or raised from wellbore 32, and tubular 30 may be rotated to free tubular 30 from tight spots in wellbore 32. In particular, when tool 14 is interconnected between top drive unit 12 and tubular 30, connections between joints of tubulars 30 may be made up and broken via holding one section of tubular 30 below a tubular joint in slips 38 and rotating tool 14 connected to a section of tubular 30 above the tubular joint via top drive 12.

When tool 14 is inserted within tubular 30, and sealing element 90 is in sealing contact with tubular 30 substantially preventing the flow of fluid through the annulus between the interior of tubular 30 and tool or tools holding sealing element 90, tool 14 may be utilized for circulating operations. To circulate fluid through tubular 30 and the annulus between tubular 30 and wellbore 32, sealing element 90 is placed in sealing contact with the interior surface of tubular 30. As described above, sealing element 90 may be of many different forms and activated in many different ways, such as friction fit elements, cups, inverted cups, inflatable packers, etc. Once sealing element 90 is placed in a sealing position, fluid is pumped via fluid pump 20 or cement pumps 24 through hose 22 and internal gripping tool 14 past the sealing element 90 and through the lower end of tubular 30 (not shown) and back up the annulus between tubular 30 and wellbore 32.

When desired to utilize internal gripping tool 14 in cementing operations a cementing head or drop assembly 92 may be connected to top end 58 and a wiper plug assembly 94 connected to bottom end 60 of tool 14. As shown in FIG. 6, wiper plug assembly may be connected below a sealing element 90 which may be added to tool 14 or be a unitary piece of tool 14. Additionally, circulating tool 88 such as one shown in FIG. 5, may be included within the assembly, one example of use of circulating tool 88 and a wiper plug assembly 94 is described in U.S. Pat. No. 5,735,348 and its progeny. Although not shown in FIG. 6, cementing head may be connected to a fluid source for operation by such elements as a kelly valve, and/or directly through top drive unit 12, and a connector which are all known in the art, or fluid source 20 or 24 may be connected to tubular 30, via tool 14, circulating tool 88 or in other manners known in the art. It should also be recognized that other subs, connectors, and tools which are not shown may be used in connection with internal gripping tool 14 and in the entire working assembly.

To cement tubular 30 within wellbore 32, internal gripping tool 14, wiper plug assembly 94, are inserted within the top of tubular 30 so that sealing element 90 is in sealing engagement with the interior of tubular 30. To begin cementing a ball or dart (not shown) is released from cementing head 92 through the assembly and into wiper plug assembly 94. Bottom wiper plug **94*b*, is released from assembly 94 and is pumped down tubular 30 ahead of a cement volume calculated to fill the annulus between tubular 30 and wellbore 32. As bottom plug 94*b* is pumped down tubular 30 it cleans the interior of tubular 30 and pushes fluid out of tubular 30 and up through the annulus between tubular 30 and wellbore 32. A second ball or dart is then released from cementing head 92 severing top plug 94*a* from assembly 94. Second plug 94*a* is then pumped down tubular 33 ahead of a drilling fluid stream forcing the cement into the annulus between tubular 32 and wellbore 32. At this point, internal casing tool 14** and any connected equipment may be removed to continue drilling or completion operation.

Those who are skilled in the art will readily perceive how to modify the present invention still further. For example, many connections illustrated are threaded, however, it should be recognized that other methods of connection may be utilized, such as by welding. Additionally, there are many connectors and spacers and additional equipment which may be used within and in connection with the present invention. In addition, the subject matter of the present invention would not be considered limited to a particular material of construction. Therefore, many materials of construction are contemplated by the present invention including but not limited to metals, fiberglass, plastics as well as combinations and variations thereof. As many possible embodiments may be made of the present invention without departing from the scope thereof, it is to be understood that al matter herein ser forth or shown in the accompanying drawings is to be interpreted as illustrative and not in a limiting sense.

What is claimed is:

1. A tubular running tool connectable to a drilling rig assembly for inserting and selectively internally gripping a tubular member, said tubular running tool comprising:

a barrel member;

at least one slip for selectively engaging an interior portion of said tubular member; and a moving mechanism comprising an inner tubular element and an outer tubular element such that an annulus is formed between said inner tubular element and said outer tubular element, a tubular piston axially moveable within said annulus and being interconnected to said at least one slip for moving said at least one slip relative to said barrel member between a first position for gripping said tubular member and a second position for releasing said tubular member.

2. The tubular running tool of claim 1, further comprising:

said tubular piston being in encircling relationship to said barrel member.

3. The tubular running tool of claim 1, wherein said tubular cylinder housing further comprises:

said tubular piston being secured to a tubular cylinder rod.

4. The tubular running tool of claim 1, wherein said barrel member further comprises:

a taper section.

5. The tubular running tool of claim 1, wherein said barrel member defines an axial flow path therethrough.

6. The tubular running tool of claim 1, further comprising:

pneumatic connections to said tubular cylinder housing.

7. A method for making a tubular running tool, said tubular running tool being connectable to a drilling rig assembly for inserting and selectively internally gripping a tubular member, said method comprising:

providing a barrel member;

providing a cylindrical chamber in encircling relationship with respect to said barrel member;

positioning a cylindrical piston within said cylindrical chamber;

mounting said cylindrical chamber to said barrel such that said annular chamber is axially moveable with respect to said barrel, said cylindrical piston being axially moveable with respect to said cylindrical chamber; and providing at least one slip operably connected to said cylindrical piston for movement of said at least one slip between a first position and a second position for selectively gripping and releasing said tubular member.

8. The method of claim 7, further including:

providing an axial flow path through said barrel member.

9. The method of claim 7, further including:

connecting a piston rod to said cylindrical piston.

10. The method of claim 7, further including:

providing a pneumatic connection to said cylindrical chamber.

11. The method of claim 7, further including:

providing an inclined surface at one end of said barrel.

12. The method of claim 7, further comprising:

providing said cylindrical chamber with an inner tubular member and an outer tubular member.

13. The method of claim 7, further including:

connecting at least one pivotal leg member to at least one slip, and connecting a piston rod to said at least one pivotal leg member.

14. The method of claim 7, further including:

providing seals on said cylindrical piston for sealed movement of said cylindrical piston within said cylindrical chamber.

15. The method of claim 14, further including:

connecting a pneumatic lines to said cylindrical chamber above and below furthest movement of said cylindrical piston within said cylindrical chamber for pneumatic operation of said cylindrical piston.

* * * * *

UNITED STATES PATENT AND TRADEMARK OFFICE

CERTIFICATE OF CORRECTION

PATENT NO. : 6,431,626 B1
APPLICATION NO. : 09/502898
DATED : August 13, 2002
INVENTOR(S) : Bouligny et al.

It is certified that error appears in the above-identified patent and that said Letters Patent is hereby corrected as shown below:

Col. 12, lines 54 - 67, to Col. 13, lines 1 - 4
CLAIM 7
Change Claim 7 from:

7. A method for making a tubular running tool, said tubular running tool being connectable to a drilling rig assembly for inserting and selectively internally gripping a tubular member, said method comprising: providing a barrel member; providing a cylindrical chamber in encircling relationship with respect to said barrel member;positioning a cylindrical piston within said cylindrical chamber;mounting said cylindrical chamber to said barrel such that said annular chamber is axially moveable with respect to said barrel, said cylindrical piston being axially moveable with respect to said cylindrical chamber; and providing at least one slip operably connected to said cylindrical piston for movement of said at least one slip between a first position and a second postition for selectively gripping and releasing said tubular member.

To the following:

7. A method for making a tubular running tool, said tubular running tool being connectable to a drilling rig assembly for inserting and selectively internally gripping a tubular member, said method comprising: providing a barrel member; providing one or more tubular members to define a cylindrical chamber in encircling relationship with respect to said barrel member; positioning a cylindrical piston within said cylindrical chamber; mounting said cylindrical chamber to said barrel such that said one or more tubular members are axially moveable with respect to said barrel, said cylindrical piston being axially moveable within said cylindrical chamber with respect to said one or more tubular members and said barrel; and providing at least one slip operably connected to said cylindrical piston for movement of said at least one slip between a first position and a second position for selectively gripping and releasing said tubular member.

Signed and Sealed this

Fourth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 6,431,626 B1
APPLICATION NO. : 09/502898
DATED : August 13, 2002
INVENTOR(S) : Bouligny et al.

It is certified that error appears in the above-identified patent and that said Letters Patent is hereby corrected as shown below:

Title Page

Item: "(75) Inventor: Vernon J. Bouligny, New Iberia, LA (US)" is corrected to:

Item: -- (75) Inventors: Vernon J. Bouligny, New Iberia, LA (US);
Charles M. Webre, Lafayette, LA (US);
Brian D. Begnaud, New Iberia, LA (US)--

Signed and Sealed this

Twenty-fifth Day of December, 2007

JON W. DUDAS
*Director of the United States Patent and Trademark Office*